US009200406B2

(12) United States Patent
Enqvist et al.

(10) Patent No.: US 9,200,406 B2
(45) Date of Patent: Dec. 1, 2015

(54) PRODUCTION OF PULP USING A GASEOUS ORGANIC AGENT AS HEATING AND REACTION-ACCELERATING MEDIA

(75) Inventors: Eric Enqvist, Helsingfors (FI); Panu Tikka, Espoo (FI); Leopold Heinrich, Graz (AT); Matti Luhtanen, Pori (FI)

(73) Assignee: Valmet Technologies, Inc. (FI)

( * ) Notice: Subject to any disclaimer, the term of this patent is extended or adjusted under 35 U.S.C. 154(b) by 1390 days.

(21) Appl. No.: 11/886,702

(22) PCT Filed: Feb. 10, 2006

(86) PCT No.: PCT/FI2006/050059

§ 371 (c)(1),
(2), (4) Date: Sep. 19, 2007

(87) PCT Pub. No.: WO2006/103317

PCT Pub. Date: Oct. 5, 2006

(65) Prior Publication Data

US 2009/0014138 A1 Jan. 15, 2009

(30) Foreign Application Priority Data

Mar. 31, 2005 (FI) ..... 20055143

(51) Int. Cl.

| | |
|---|---|
| ***D21C 3/20*** | (2006.01) |
| *D21C 1/00* | (2006.01) |
| *D21C 3/22* | (2006.01) |

(52) U.S. Cl.

CPC .. *D21C 3/20* (2013.01); *D21C 1/00* (2013.01); *D21C 3/222* (2013.01)

(58) Field of Classification Search

USPC ..... 162/77

See application file for complete search history.

(56) References Cited

U.S. PATENT DOCUMENTS 3,585,104 A * 6/1971 Kleinert ..... 162/17
4,100,016 A 7/1978 Diebold et al.

(Continued)

FOREIGN PATENT DOCUMENTS

CA 725072 1/1966
EP 0262988 A2 4/1988

(Continued)

OTHER PUBLICATIONS

Gullichsen, "Papermaking Science and Technology", Chemical Pulping, Book 6B, Chapter 20, pp. B410-B427, Helsinki Finland, 1999.

(Continued)

*Primary Examiner* — Jacob Thomas Minskey

(74) *Attorney, Agent, or Firm* — Lerner, David, Littenberg, Krumholz & Mentlik, LLP

(57) ABSTRACT

The invention relates to an improved process to break down lignin macromolecules and liberating cellulose fibers in lignocellulosic material using delignifying reactants with a gaseous organic agent as a heating and reaction-accelerating media. Lignocellulosic material is first impregnated with reactant chemicals, e.g. commonly used agents such as sodium hydroxide and sodium sulfide. Subsequently, the energy required for the delignification reactions is provided through heating with a gaseous organic agent such as methanol or ethanol, condensing and releasing energy to the solid lignocellulosic material. The temperature during the heating step with a gaseous organic agent is higher than the temperature during the impregnation step.

8 Claims, 1 Drawing Sheet

(56) References Cited

U.S. PATENT DOCUMENTS

| | | | | | |
|---|---|---|---|---|---|
| 4,135,967 | A | * | 1/1979 | Fogarassy | 162/29 |
| 4,790,905 | A | | 12/1988 | Nivelleau de La Bruniere et al. | |
| 4,826,566 | A | | 5/1989 | Burkart | |
| 5,338,405 | A | * | 8/1994 | Patt et al. | 162/25 |
| 5,382,321 | A | | 1/1995 | Fagerlind et al. | |
| 5,470,433 | A | | 11/1995 | Brodersen et al. | |
| 5,650,045 | A | | 7/1997 | Salminen | |
| 5,788,812 | A | | 8/1998 | Agar et al. | |
| 2004/0060673 | A1 | * | 4/2004 | Phillips et al. | 162/22 |

FOREIGN PATENT DOCUMENTS

| | | | |
|---|---|---|---|
| WO | WO-93/20279 | A1 | 10/1993 |
| WO | 96/41052 | A1 | 12/1996 |
| WO | 2004/106624 | A1 | 12/2004 |

OTHER PUBLICATIONS

Supplementary European Search Report, EP 06708963 dated Dec. 1, 2010.

* cited by examiner

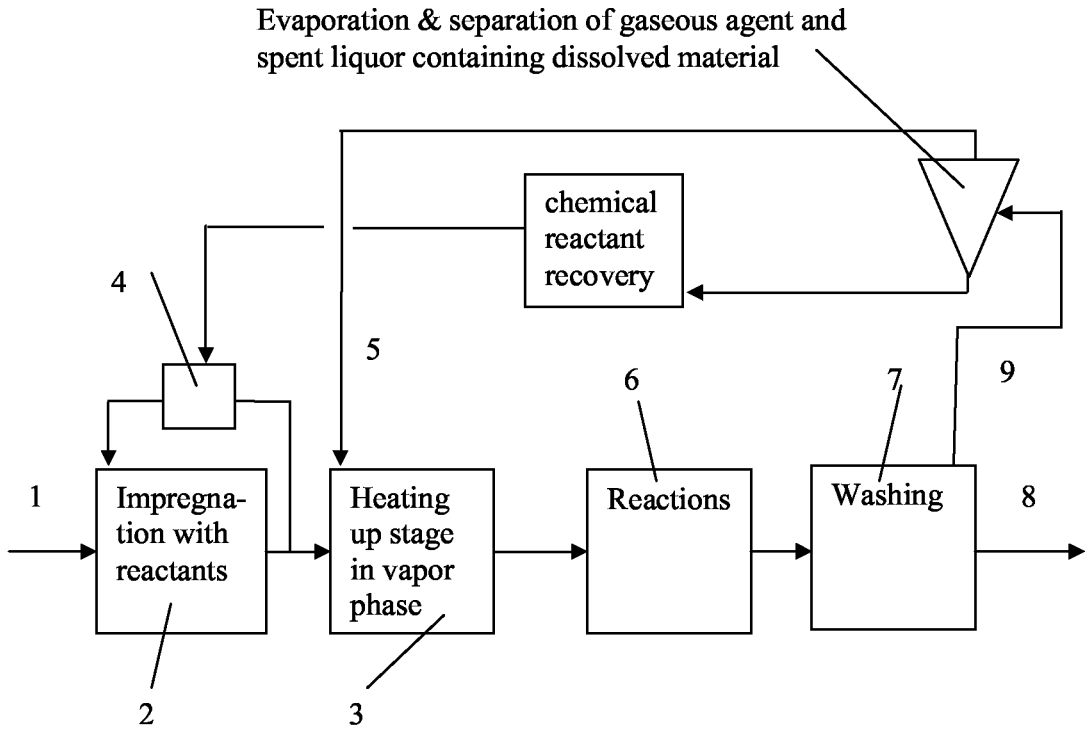
Evaporation & separation of gaseous agent and spent liquor containing dissolved material
chemical reactant recovery
4
5
6
7
9
1
Impregna-tion with reactants
Heating up stage in vapor phase
Reactions
Washing
8
2
3

PRODUCTION OF PULP USING A GASEOUS ORGANIC AGENT AS HEATING AND REACTION-ACCELERATING MEDIA

FIELD OF THE INVENTION

The present invention relates to a process for the production of pulp. More specifically, the present invention relates to an improved process to break down lignin macromolecules and liberate cellulose fibers in lignocellulosic material using delignifying reactants with a gaseous organic agent as a heating and reaction-accelerating media.

BACKGROUND OF THE INVENTION

The majority of the papermaking pulp produced in the world today is produced by the so-called kraft method. Kraft pulping produces strong fibers, a fact that has given the method its name. This method, however, has the drawback of being very capital intensive. This is due to the need for a very complex system for chemicals recovery and very large unit sizes in the reactors. The reactors have in fact become so big that controlling the actual reactions and liquor circulations has become extremely difficult. The huge unit sizes in all parts of the process also leads to very large in-process inventory and a process that reacts very slowly to e.g. grade changes, etc. Any improvement that would lead to a faster process with shorter in-process delays would therefore have to be seen as a big step forward.

Another problem regarding the kraft method is the use of sulfur, which leads to larger amounts of chemicals being in circulation, odor problems, as well as making the recovery of spent chemicals extra complicated. A process without sulfur would make it possible to have much more efficient burning processes for the dissolved organic material in the process.

In order to address the problems of slow and cumbersome processes and to get rid of the sulfur, and often all inorganic chemicals in the process, several researchers have proposed the use of organic solvents to act as a cooking chemical and dissolve the lignin that holds the cellulose fibers together in wood.

According to J. Gullichsen, C-J Fogelholm, Book 6A, Papermaking Science and Technology, Fapet, 1999, Helsinki, Finland, p. B411, the pulping methods using organic solvents can be classified as follows:

- Autohydrolysis methods, in which organic acids released from the wood by thermal treatment act as delignification agents
- Acid catalyzed methods, in which acid agents are added to the material
- Methods using phenols
- Alkaline organosolv methods
- Sulfite and sulfide cooking in organic solvents
- Cooking using oxidation of lignin in organic solvent The basic idea in autohydrolysis, as explained for instance in U.S. Pat. No. 3,585,104 (Kleinert), is to cook the wood in a solvent at high temperature. The high temperature leads to hydrolysis of sugars present in the wood, thus releasing acids. These acids are then supposed to break down and dissolve lignin together with the solvent. The drawback of this process is that very harsh conditions are needed in order to properly delignify the wood. This leads to yield losses and low pulp quality. Others have attempted to improve on the basic idea in order to improve the pulp quality. One such attempt is the so-called IDE process described in EP 0 635 080. The idea is to limit the drop in pH in order to salvage pulp quality. The process is proposed to achieve this by cooking using solvent in a countercurrent manner, thus removing the acids as they are formed early in the cook, and by adding alkali to maintain the pH as desired. The method has never been possible to implement on a commercial scale, possibly due to the large amount of solvent needed to maintain the proposed countercurrent flow. Further, even in the laboratory it is not well suited for all wood species.

If pulp quality is not seen as a major criteria (emphasis on by-product value), acid can be added to the system to increase the speed of the pulping process. Processes have for instance been developed that use acetic and formic acid as delignification agents. The drawback for these processes is that there is no market for the inferior quality pulp, and that severe corrosion problems arise in the equipment.

The so-called Organocell process has been closest to large-scale commercialization of the solvent-using pulping methods. This process is a variant of alkaline organosolv pulping, using simultaneous action of soda-anthraquinone and organic solvent on the lignin. The process seemed to give acceptable pulp quality in the laboratory, but when tried on mill scale the results were not satisfactory.

All prior pulping methods employing organic solvents have been attempts to develop substitutes for the presently dominating kraft pulping method. However, kraft pulping has been constantly improved upon for the last 100 years and is today quite efficient and thus hard to compete with. This can be seen from the fact that no solvent pulping method has proven to be commercially viable. There is, however, still room for improvement in the kraft process itself. For example, the odors of the process are seen as a problem, as is the fact that the reactors are becoming increasingly large and hard to control. Steps have been taken to improve alkaline kraft pulping. One such method is rapid steam phase pulping. The idea is to impregnate the wood with all the alkaline chemicals needed for the reactions in an impregnation stage, followed by heating in a water steam phase. This would make the reactors smaller and partly remedy the problems with odor as described in Canadian Patent No. 725,072. However, this method has not demonstrated enough improvement over the kraft process in liquid phase—yield increase has been very small and reactors still very big, leading to too high chip columns in vapor phase, in turn leading to compaction and collapsing of the digester content, thus plugging flows and destroying pulp quality.

In light of the current research it is clear that the previous research has failed largely because the true role of the organic solvent was not identified. In the current research it has been clearly seen that organic solvents do not participate in the reactions themselves as a solvent of lignin or active chemical, but in fact only have the impact of providing such a reaction environment as to boost the efficiency of other delignifying chemicals.

SUMMARY OF THE INVENTION

In accordance with the present invention, these and other objects have now been realized by the invention of a process for production of pulp from comminuted lignocellulosic material comprising impregnating the comminuted lignocellulosic material in a liquid phase containing fresh reactants at a first temperature so as to produce impregnated lignocellulosic material, removing a majority of the liquid surrounding the impregnated lignocellulosic material, heating the impregnated lignocellulosic material to a second predetermined reaction temperature using the heat released by the condensation of a gaseous organic agent, and maintaining the second predetermined reaction temperature for a desired reaction time, the second predetermined reaction temperature being higher than the first temperature. In a preferred embodiment, the fresh reactants comprise a solution containing at least one of a hydroxide, a sulfide, an anthraquinone, a carbonate, a polysulfide ion, a sulfite or an acid.

In accordance with one embodiment of the process of the present invention, the gaseous organic agent is an aliphatic alcohol, a ketone, or an aldehyde. In a preferred embodiment, the organic agent is methanol, ethanol, propanol, butanol, acetone or a mixture of these compounds, preferably in a purity of over 50% with the remainder being water and impurities.

In accordance with one embodiment of the process of the present invention, the first temperature is between about 20 and 130° C.

In accordance with another embodiment of the process of the present invention, the second predetermined reaction temperature is a maximum of between about 120 and 200° C.

In accordance with another embodiment of the process of the present invention, the impregnating step is between about 10 and 120 minutes long.

In accordance with another embodiment of the process of the present invention, the heating step is between about 2 and 400 minutes long.

In accordance with the present invention, an improved method for producing pulp from lignocellulosic material has been provided.

According to the present invention, the lignocellulosic material is first impregnated with reactant chemicals. This can be performed by submersing the material in a solution containing the chemicals, followed by a removal of excess liquid. The liquid can be any solution containing a delignifying agent. Examples of such liquids are aqueous solutions of hydroxide, sulfide, sulfite, bisulfite, carbonate (e.g. the sodium compounds), sulphur dioxide, anthraquinone, amines or acids. The impregnation can also be performed by contacting the material with delignifying chemicals in the gas phase. An example of this is sulphur dioxide gas that is taken up by the chip moisture.

Subsequently, the energy required for the delignification reactions is provided through heating with a gaseous organic agent, condensing and releasing energy to the solid lignocellulosic material. For the purpose of this specification, a gaseous organic agent is any organic material above its boiling temperature at the pressure of the process at the relevant stage. The gaseous organic agent may comprise various amounts of vapors or droplets, i.e. it need not be in a completely gaseous state. Examples are lower alkyl alcohols, ketones and aldehydes. Mixtures of organic agents may be used, and the agent may contain water. In an industrial process it will not be practical to purify the stream of circulated organic agent. Therefore, the composition will change over time and become a mixture of several volatile compounds. For the purpose of the present invention it is considered that the heating media used is the same as originally used, as long as at least 50% (by mass) of the heating stream is made up of the original organic agent or agents. Preferably, the mass percentage of organic agent(s) in the heating stream is at least 60; more preferably, at least 75; and most preferably at least 90.

Preferable agents include methanol, ethanol, propanol, butanol, acetone and any mixture thereof.

Preferably, the temperature during the impregnation step is in the range of from about 20 to 130° C., and the duration of this step is in the range of about 10 to 130 min. The temperature during the heating step with a gaseous organic agent is higher than the temperature during the impregnation step.

Preferably, the temperature during the heating step reaches a temperature in the range of from about 120 to 200° C.; the pressure during the step evidently corresponds to the physical properties of the organic agent or mixture of agents used. Preferably, the duration of this step is in the range of from about 2 to 400 min.

A surprising benefit is seen when pre-impregnated material is heated by this means. The beneficial effects include very rapid reactions, high yield, lowered energy demand, lowered demand of cooking chemicals and lower rejects compared to conventional kraft pulping. In contrast to earlier work on the so called organosolv processes, the present invention does not involve using the organic agent to dissolve or react with lignin, but rather, the organic agent provides a new kind of non-aqueous media for rapid heating and acceleration of reactions taking place inside the impregnated chips.

The benefit seen from the surprising rise in the speed of delignification can be utilized in several ways, including those mentioned below. For instance, a pulp mill restricted in chemicals recovery capacity could produce much more pulp due to better pulp yield and lower cooking chemicals consumption.

On the other hand, a pulp mill restricted by digester volume could enjoy increased throughput due to a faster process. It could use lower temperatures and gain heat efficiency. A mill restricted by the bleaching line could delignify the wood further in cooking and thus increase production.

BRIEF DESCRIPTION OF THE DRAWING

In the following detailed description, the method of the present invention is disclosed in detail, all reference numerals relating to FIG. 1, which is a schematic elevational view of the essential process steps of the present invention.

DETAILED DESCRIPTION

Lignocellulosic materials, such as any type of wood, straw or bamboo, is comminuted into easily processed parts (chips in the case of wood; in the following, reference is made to chips) as is customary. The chips are steamed to facilitate air removal. Referring to FIG. 1, the steamed chips (1) are brought into contact with liquid containing lignin-breaking reactants, as disclosed above, at a high concentration (2). The chips are impregnated with the liquid under such conditions that enough reactants are transferred to the chips to enable lignin cleavage to the desired level. The dosage of reactants and combination of time and temperature in both the impregnation and the delignification steps are chosen based on the desired degree of delignification.

Impregnation using a gaseous compound can also be used utilizing a chemical that is enriched in the moisture present in the chips.

After impregnation, the excess liquor is removed and concentrated for reuse (4) and the chips are brought into contact with a gaseous organic agent at the preferred temperature. This constitutes the heat-up stage (3), where the gaseous organic agent is brought in through line 5. The condensation of the heated gaseous agent on the chips releases energy, thus heating the chips to the reaction temperature at which the chips are kept for a predetermined time in stage 6. The temperature is maintained by adding organic agent as needed. After the reaction time the chips are washed and cooled down in stage 7, according to methods known by those skilled in the art. From the washing stage, a mixture of wash water, spent chemicals and organic agent is removed in stream 9. This mixture is heated to vaporize the organic agent, which is then recycled to the heating stage. The spent delignification chemicals are recovered using an appropriate technique, such as current recaustisizing methods, and brought back into the impregnation step.

There are several possible ways to utilize the present invention, depending on which aspect of chemical pulping is seen as the most valuable. Below are a few examples of the aim of the process and what a possible embodiment would be to achieve this aim.

In one variation of the process of the present invention, aiming at minimizing the physical size of a batch digester the process is as follows. The digester is filled with chips according to prior art methods. The digester is then filled with white liquor and impregnation is performed for 10 to 120 minutes at 20 to 130° C. After the impregnation time the spent impregnation liquor is withdrawn and recycled. The chips (without free liquor) are then heated to between 140 and 200° C. by allowing gaseous methanol to condense on the chips and by keeping the digester at this temperature for the duration of the reactions by the addition of gaseous methanol.

In a preferable embodiment for a continuous process, the chips are steamed and brought into an impregnation vessel where they are impregnated with white liquor at 20 to 130° C. for 10 to 120 minutes. The impregnation vessel can be built with either co- or countercurrent liquor flow configuration, according to principles known to a person skilled in the art. From the impregnation vessel the chips are transferred to the digester, at the top of which the free liquor is removed from the chips, according to prior art methods. When the liquor has been removed the chips are fed forward so that they are brought into contact with a methanol vapor atmosphere at 140 to 200° C. and kept at this temperature for the duration of the reaction time. The digester used can be similar to present continuous kraft digesters or specifically built for the present invention.

In a preferred embodiment of the present invention aimed at minimizing cooking plant (batch or continuous) steam consumption, impregnation is performed at 30 to 130° C. and a reaction temperature of 120 to 140° C. is used, the reaction temperature however being higher than the impregnation temperature.

In a preferred embodiment aimed at achieving maximum pulping capacity for a given capacity of chemicals recovery, the impregnation is performed using diluted white liquor and the reaction time is extended to that typical of present generation digesters.

In a preferred embodiment aimed at simplifying the chemicals recovery, the improved cooking efficiency can be used to make it possible to use sulfur-free cooking that does not require the use of the so called lime cycle in chemicals recovery. Such processes are green liquor pulping, pulping using carbonate or autocaustisizing using borohydride.

In a preferred embodiment of the present invention, it is used to pulp raw materials other than wood, such as straw, reeds or bamboo. Due to the boost given to the process by heating using a gaseous organic agent, less powerful lignin degrading chemicals, such as carbonate, can be used in the process.

In addition to the embodiments presented above based on the dominating pulping method, kraft cooking, the invention boosts the reactions of any cooking method, such as sulfite and bisulfite cooking.

EXAMPLES

The method of the present invention can be used with a wide variety of raw materials and cooking methods. In the following examples, numerical data for tests with both wood and straw pulping is presented. All tests have been performed using the same laboratory scale digester. "Steam" refers to steam phase water.

The digester used has been purposely built to facilitate the testing of vapor phase processes. The design includes a special heating jacket that prevents the heating power of the vapor from being spent on heating the digester itself. This problem, typical for laboratory scale systems, will not arise in industrial applications as the ratio of wood to equipment weight is much higher.

Wood as Raw Material

| | |
|---|---|
| Experimental Wood: | fresh softwood mill chips, dry matter content 50% |
| Batch size: | 400 g wood as oven dry mass |
| Chemicals: | mill white liquor |
| Digester size: | 2200 ml |

TABLE 1

Amounts of liquor used in softwood pulping experiments:

| | |
|---|---|
| Cooking liquor in batch pulping (same liquor present throughout the process) | 2000 ml |
| Steam phase & present invention: | |
| Impregnation liquor: | 1500 ml |
| Impregnation liquor removed: | 800 ml |
| Heating agent fed into the system: | 600 ml |

TABLE 2

Comparison of process conditions in softwood pulping using prior art technology and the present invention.

| | Conventional batch kraft | Batch kraft with methanol | Kraft steam phase | Present invention |
|---|---|---|---|---|
| Impregnation temperature (° C.) | 90 | 95 | 80 | 80 |
| Impregnation time (min) | 60 | 60 | 60 | 60 |
| Alkali into reaction stage (EA on wood as NaOH)[1] | 25% | 25% | 19% | 19% |
| Composition of heating media: | | | | |
| $H_2O$ steam | | | 100% | |
| Liquid $H_2O$ | 100% | 40% | | |
| Organic agent liquid | | 60% | | |
| Gaseous organic agent | | | | 100% |
| Reaction temperature (° C.) | 175 | 175 | 175 | 175 |

[1]In conventional pulping, the term alkali charge is used to determine how much chemical is used. In vapor phase pulping, the important variable is the amount of alkali that has been absorbed by the wood prior to the reaction stage. In the conventional and batch kraft examples the number relates to alkali charge; in the steam phase and in the examples of the present invention, the number has been calculated by subtracting the charge of alkali left in the spent impregnation liquor from the amount originally charged Results

TABLE 3

Results from softwood pulping using prior art technology and the present invention.

| | Conventional batch kraft | Batch kraft with methanol | Kraft steam phase | Present invention |
|---|---|---|---|---|
| Kappa number | 23 | 23 | 23 | 23 |
| Reaction time (min) | 80 | 73 | 74 | 38 |
| Alkali consumption (EA on wood as NaOH) | 17.4% | 18.9% | 16.9% | 15.5% |
| Total yield (% on wood) | 44.6 | 45.7 | 48.7 | 49.8 |
| Rejects (% on wood) | 0.1 | 0.2 | 0.1 | 0.1 |

As can be seen from Table 3, the benefits of the present invention are quite clear. Compared to liquid phase processes (conventional batch kraft and batch kraft with methanol) the amount of chemicals needed in the digester in the reaction stage is much lower. Also, compared to a steam phase without methanol, the present invention offers a huge benefit in terms of total reaction time and alkali consumption. The benefit seen in reaction time can also be translated to a lower need for alkali in the reaction stage, or lower reaction temperature when using the same reaction time as for the other processes, further increasing the flexibility of the process.

In the above example all cooks have been performed at the same reaction temperatures. Therefore, the benefit of accelerated cooking kinetics can be seen directly as a decrease in reaction time. In practical chemical pulping, time and temperature is usually combined into a single variable, the so-called H-factor. In experiments at varying temperatures it has been seen that the benefits of the current process are observed as a decrease of almost 50% in the H-factor required to reach a certain degree of delignification, regardless of temperature.

Non-Wood Raw-Materials

The present invention is also suitable for use with other raw-materials than wood, and also enables the use of cooking chemicals that under normal circumstances lack the delignifying power to produce acceptable pulp. Table 5 shows a comparison between the use of steam phase pulping and the present invention for straw delignification, using only carbonate as the pulping chemical. Both cooks have been performed identically except for the choice of heating media.

Experimental

Raw-material: air dried wheat straw, dry matter content 90%

Batch size: 250 g as oven dry straw

Pre-treatment: the straw was cut into approx. 5 cm long pieces for easy handling Equipment: present invention and steam-phase pulping performed in the same digester as the softwood experiments. The conventional pulping experiment shown in Table 6 was performed using a simple air-heated autoclave digester.

TABLE 4

Amounts of liquor used in straw pulping experiments:

| | |
|---|---|
| Cooking liquor in batch pulping (same liquor present throughout the process) | 2000 ml |
| Steam phase & present invention: | |
| Impregnation liquor: | 2000 ml |
| Impregnation liquor removed: | 1000 ml |
| Heating agent fed into the system: | 600 ml |

TABLE 5

Comparison of wheat straw pulping performance of steam phase pulping and the present invention using $Na_2CO_3$ as the delignification reagent.

| | Carbonate AQ steam-phase | Present invention |
|---|---|---|
| Impregnation temperature (° C.) | 80 | 80 |
| Impregnation time (min) | 60 | 60 |
| Concentration of NaOH in impregnation/cooking liquor (g/l) | 0 | 0 |
| Alkali into reaction stage (% $Na_2CO_3$ on straw) | 107 | 99 |
| AQ in impregnation (% on straw) | 0.2 | 0.2 |
| Reaction temperature (° C.) | 160 | 160 |
| Time at reaction temperature (min) | 71 | 69 |
| Kappa number | 58 | 18 |
| Total yield (% on straw) | 58.3 | 52.4 |
| Rejects (% on straw) | 15.3 | 2.9 |

From Table 5 it can clearly be seen how the accelerating effect of the organic agent makes it possible to produce low-reject pulp using only carbonate as the pulping chemical. The pulp produced with the steam-phase method is unusable as papermaking pulp due to high rejects and high lignin content. The fact that no sodium hydroxide is needed in the present invention constitutes an immense benefit over present industrial processes, as chemicals recovery can be simplified drastically.

TABLE 6

Comparison of the wheat straw pulping performance of the present invention using $Na_2CO_3$ and state of the art technology using NaOH

| | Conventional batch soda AQ process | Present invention |
|---|---|---|
| Impregnation temperature (° C.) | No separate impregnation | 90 |
| Impregnation time (min) | No separate impregnation | 60 |
| Heat-up time (min) [1] | 45 | 9 |
| Concentration of NaOH in impregnation/cooking liquor (g/l)[2] | 31 | 0 |
| Concentration of $Na_2CO_3$ in impregnation/cooking liquor (g/l) [2] | 9.3 | 212 |

TABLE 6-continued

Comparison of the wheat straw pulping performance of the present invention using $Na_2CO_3$ and state of the art technology using NaOH

| | Conventional batch soda AQ process | Present invention |
|---|---|---|
| AQ in impregnation/cooking (% on straw) | 0.1 | 0.2 |
| Reaction temperature (° C.) | 160 | 160 |
| Time at reaction temperature (min) | 10 | 69 |
| Kappa number | 17 | 18 |
| Total yield (% on straw) | 49.1 | 52.4 |
| Rejects (% on straw) | 3.4 | 2.9 |

[1] Heat-up 25-160° C. for conventional, 90-160° C. for present invention

[2] In conventional - all liquid used in cooking, in present invention - free liquor removed after impregnation Table 6 shows a comparison between the present invention and the currently industrially important soda-AQ method. As can be seen, the yield of pulp is superior in the present invention and no sodium hydroxide is needed. The benefits of the present invention are hereby twofold. Investment costs for a new mill are kept low as chemicals recovery is simplified and the operating costs are lower, as less raw material is required for the production of a given amount of pulp.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A process for the production of pulp from comminuted lignocellulosic material, comprising first impregnating said comminuted lignocellulosic material in a liquid phase containing fresh reactants comprising an impregnation solution containing at least one compound selected from the group consisting of hydroxides, sulfides, anthroquinones, carbonates, polysulfite ions, sulfites, and acids at a first temperature so as to produce impregnated lignocellulosic material impregnated with an impregnation solution capable of delignification, subsequently removing a majority of the liquid surrounding said impregnated lignocellulosic material, subsequently heating said impregnated lignocellulosic material to a second predetermined reaction temperature using the heat released by the condensation of a gaseous organic agent in contact with said impregnated lignocellulosic material, and subsequently maintaining said second predetermined reaction temperature for a desired reaction time in order to permit said impregnation solution to react with and dissolve the lignin in said lignocellulosic material, said second predetermined reaction temperature being higher than said first temperature.

2. A process according to claim 1, wherein said gaseous organic agent is selected from the group consisting of aliphatic alcohols, ketones and aldehydes.

3. A process according to claim 2, wherein said gaseous organic agent is selected from the group consisting of methanol, ethanol, propanol, butanol, acetone and any mixtures thereof.

4. A process according to claim 3 wherein said gaseous organic agent is present in a purity of greater than 50%, and further includes water and impurities.

5. A process according to claim 1, wherein said first temperature is between 20 and 130° C.

6. A process according to claim 1, wherein said second predetermined reaction temperature is a maximum of between 120 and 200° C.

7. A process according to claim 1, wherein said impregnating step is between 10 and 120 minutes long.

8. A process according to claim 1, wherein said heating step is between 2 and 400 minutes long.

* * * * *

UNITED STATES PATENT AND TRADEMARK OFFICE

CERTIFICATE OF CORRECTION

PATENT NO. : 9,200,406 B2
APPLICATION NO. : 11/886702
DATED : December 1, 2015
INVENTOR(S) : Eric Enqvist et al.

It is certified that error appears in the above-identified patent and that said Letters Patent is hereby corrected as shown below:

On the title page of the patent item (73) Assignee: "Metso Paper, Inc., Helsinki (FI)" should be replaced with --Valmet Technologies, Inc. (FI)--

Signed and Sealed this
Seventeenth Day of May, 2016

Michelle K. Lee

Michelle K. Lee
*Director of the United States Patent and Trademark Office*